US007987793B2

(12) United States Patent
Blonk et al.

(10) Patent No.: US 7,987,793 B2
(45) Date of Patent: Aug. 2, 2011

(54) AMUSEMENT RIDE DEVICE

(75) Inventors: Stefanus Petrus Cornelis Maria Blonk, Apeldoorn (NL); Joop Roodenburg, Delft (NL)

(73) Assignee: Vekoma Rides Engineering B.V., Vlodrop (NL)

( * ) Notice: Subject to any disclaimer, the term of this patent is extended or adjusted under 35 U.S.C. 154(b) by 295 days.

(21) Appl. No.: 12/302,005

(22) PCT Filed: May 24, 2006

(86) PCT No.: PCT/NL2006/000266

§ 371 (c)(1),
(2), (4) Date: Nov. 21, 2008

(87) PCT Pub. No.: WO2007/136245

PCT Pub. Date: Nov. 29, 2007

(65) Prior Publication Data

US 2010/0236444 A1 Sep. 23, 2010

(51) Int. Cl.
*A63G 1/00* (2006.01)
*A63C 19/10* (2006.01)

(52) U.S. Cl. ..... 104/53; 104/75; 472/88

(58) Field of Classification Search ..... 104/53, 104/55, 60, 63, 74–76, 82, 83, 85, 86; 472/88, 472/90, 91; 434/247, 253
See application file for complete search history.

(56) References Cited

U.S. PATENT DOCUMENTS

| | | | | |
|---|---|---|---|---|
| 3,408,067 | A * | 10/1968 | Armstrong | 482/30 |
| 4,531,459 | A | 7/1985 | Yamada | |
| 5,979,333 | A | 11/1999 | Houben et al. | |
| 6,910,972 | B2 * | 6/2005 | Norbury | 472/85 |
| 7,632,191 | B2 * | 12/2009 | Zambelli et al. | 472/43 |
| 2002/0093165 | A1 * | 7/2002 | Greene | 280/87.041 |
| 2004/0266540 | A1 | 12/2004 | Norbury | |

FOREIGN PATENT DOCUMENTS

| | | |
|---|---|---|
| EP | 0 103 795 A2 | 3/1984 |
| EP | 1 201 280 A2 | 5/2002 |

* cited by examiner

*Primary Examiner* — S. Joseph Morano
*Assistant Examiner* — R. J. McCarry, Jr.
(74) *Attorney, Agent, or Firm* — Birch, Stewart, Kolasch & Birch, LLP

(57) ABSTRACT

Amusement ride device, comprising a track and at least one carriage, which carriage is moveable along the track in a transport direction. The carriage comprises a transport part which engages on the track, at least one platform that allows to support the feet of at least one passenger, and at least one passenger torso restraint engaging on the torso of the passenger for safely supporting the passenger. The transport part comprises one of the passenger torso restraint or the platform to support the passenger, while the other is connected by connecting means to the transport part. The connecting means are designed to allow the passenger to perform movements during the ride while being restrained by the torso restraint, wherein the torso restraint performs a movement with respect to the platform during said movements of the passenger.

36 Claims, 11 Drawing Sheets

Figures 1A, 1B, 1C:
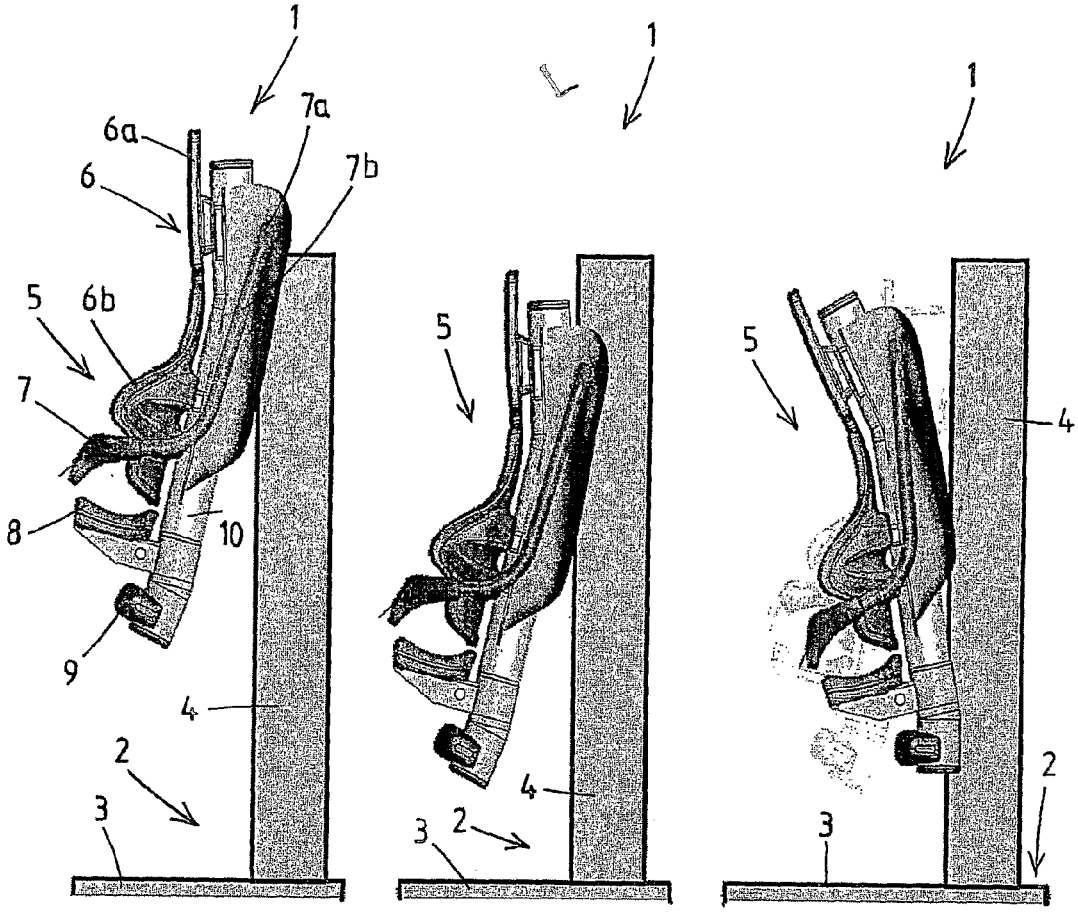

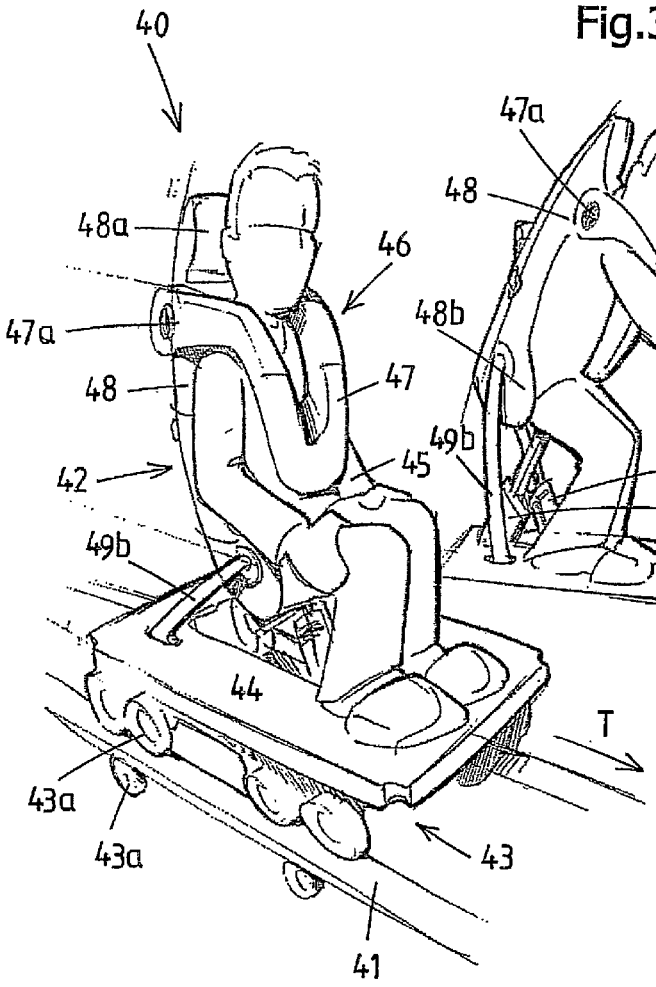
Fig.3A
Fig.3B
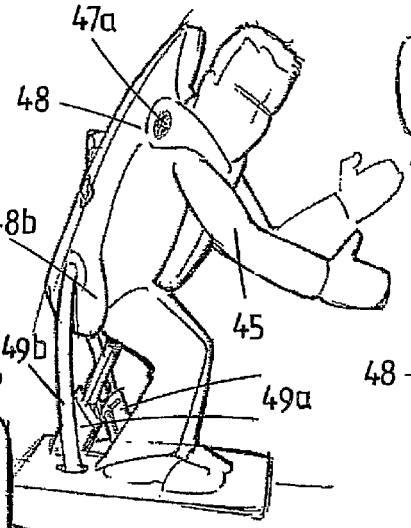
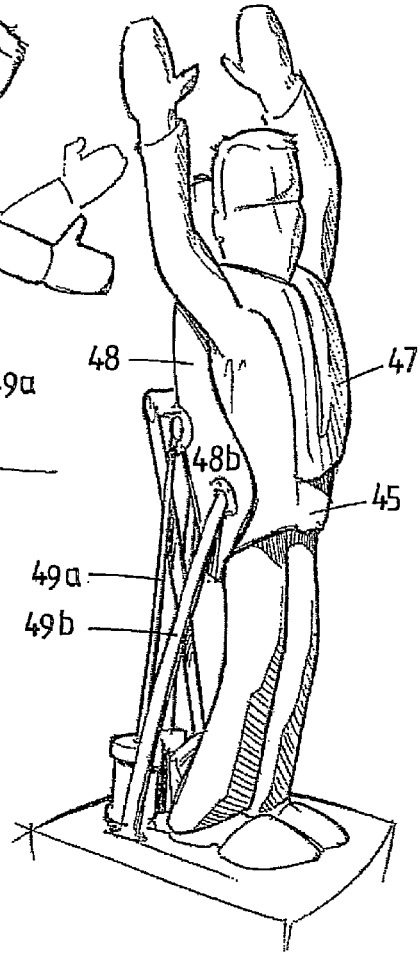
Fig.3C

AMUSEMENT RIDE DEVICE

Amusement ride device, comprising a track and at least one carriage, which carriage is moveable along the track in a transport direction, which carriage comprises:

a transport part which engages on the track at least one platform that allows to support the feet of at least one passenger, at least one passenger torso restraint engaging on the torso of the passenger for safely supporting the passenger, wherein the transport part comprises one of the passenger torso restraint or the platform to support the passenger, while the other is connected by connecting means to the transport part, This type of amusement ride device is well known from the art and applied in many stand-up roller coasters. An example of such an amusement ride device is described in U.S. Pat. No. 4,531,459. In this patent a carriage is described having a standing position support column for holding a passenger in an upright posture on a platform of a transport part which rolls or orbits along a track. A height-adjusting frame is disposed at the standing position support column to be vertically movable there-along and adjusted at a proper position in accordance with the height of the passenger. The frame has a locking mechanism for locking the height-adjusting frame during the ride. The torso restraint comprises a pair of right and left shoulder holders which support the upper half of the body and a saddle for supporting the pelvic portion of the body and an abdominal support for supporting the lower torso of the passenger. The shoulder holders are locked in the passenger holding positions during the ride.

The object of the invention is to provide an improved amusement ride device with an ameliorated ride experience.

This objective is accomplished by an amusement ride device according to the preamble of claim 1, in which the connecting means are designed to allow the passenger to perform movements during the ride while being restrained by the torso restraint, wherein the torso restraint performs a movement with respect to the platform during said movements of the passenger.

Possibly, the feet of the passenger are connected to the platform. The connection between one of the passenger torso restraint or the transport part to the platform can possibly be moveable, e.g. by vibrations.

The movements of the passenger can be performed by the passenger itself, e.g. by bending his knees, or bending one knee and stretching the other leg. This way an enhanced sense of excitement is created, allowing the passengers the possibility to create their own attitude and thus establish their own style, interpretation and intensity of the ride. The movements of the passenger can also be imposed, e.g. by electrical means or by mechanical means related to the track, adjusting the position of the passenger to the scenery present at a particular position of the track, e.g. squatting the passenger when entering a tunnel. The movements of the torso restraint with respect to the platform can either be movements of the torso restraint with respect to a 'static' platform, or movements of a platform with respect to a 'static' torso restraint, or possibly both the torso restraint and the platform are moveable.

In a preferred embodiment, the amusement ride device comprises a track and at least one carriage, which carriage is moveable along the track in a transport direction, which carriage comprises:

a transport part which engages on the track and comprises at least one platform that allows to support at least one passenger in a standing position thereon, at least one passenger torso restraint engaging on the torso of the passenger for safely supporting the passenger in at least the standing position, connecting means which connect the passenger torso restraint to the transport part, which connecting means allow a movement of the torso restraint with respect to the platform, whereby the connecting means are designed to allow the passenger to perform movements during the ride while being restrained by the torso restraint, wherein the torso restraint performs a movement with respect to the platform during said movements of the passenger.

The connecting means are preferably designed to allow the passenger to perform movements between the standing position and a squatting position, wherein the torso restraint performs an up and down movement with respect to the platform during said movements of the passenger. This enables the passenger to be restrained on the amusement ride device while being able to squat for waves, tunnels etc. etc., while the carriage moves along the track performing turns, nose dives, horseshoes, camelbacks, helixes, possibly somersaults etc. etc., thereby providing a unique thrilling amusement.

Preferably, the passenger can board and disembark the carriage along the track. The track may also be an endless track, e.g. comprising slopes, curves, inclines and possibly also loops. The track can also not be endless, and designed e.g. as a half-pipe or be arranged at a natural slope, e.g. at a skiing area in the summer. One of the most feared (and by some most loved) parts of a roller coaster ride is the first drop. In this part of the track, the train converts its height into speed. In roller coasters with long trains, the first drop is often from the lift down to one of the lowest points in the ride in order to pick up as much speed as possible. In roller coasters with single coaches, the first drop is usually a short one in which the coach gains just enough speed to reach the following element. As snowboarders and skateboarders enter the half pipe, they experience about the same; a short bursting vertical movement. Surfers experience the same when they pick up their wave. Turning during the drop would make this experience even more thrilling; this element is called a 'hairpin dive'. Preferably, a track may comprise a so-called 'trick track'. The relatively unknown 'trick track' element features a sequence of small low banked turns. This can be compared with the sideways movement skiers and snowboarders make during descending a hill. In roller coaster track terms, this means that the track rotates back and forth over the sagittal axis. Applying this element in an amusement ride according to the invention (preferably with a near-perpendicular orientation of the occupants), this trick-track element does contribute to a thrilling sensation in which the occupants can assume several body positions since the vertical loads hardly increase during the element.

The initial speed that is needed can be given to the carriage by a lift or a launch. A disadvantage of a launch might be that due to the setup of the passengers on the carriage, possible high lateral forces could be experienced by the occupants. A traditional lift possibly suits the concept of this invention better and will possible cost less.

In order to maintain balanced, humans rotate their torso while squatting. Although several ways of squatting exist, this rotation can be seen as a natural movement and is in a preferred embodiment facilitated by the carriage. Ergonomic data indicate that this rotation occurs up to about 20 degrees in forward direction. In a preferred embodiment, the connecting means are designed to also allow a forward rotational movement of the torso of the passenger during the ride while being restrained by the torso restraint.

To further enhance the movements that can be performed by a passenger during the ride while being restrained, the connecting means are possibly designed to allow a lateral movement of the torso of the passenger. This enables the passenger to stretch one leg while bending the other one, simulating a skiing movement. This lateral movement can possibly be combined with a forward rotation movement, but this is not necessary according to the invention. Possibly, the platform is moveable with respect to the transport part. E.g. the platform comprises means to enable a tilting movement of the feet made when performing skiing movements, to prevent (over-) stretching of the ankles. These means can e.g. be springs or cushions. The platform can be made actively or passively moveable with respect to the transport part, e.g. by imposing a vibration of the platform or by imposing a movement of the platform as a whole. Possibly, the platform is rotatable about a vertical axis during the ride. In an advanced embodiment, the platform supporting the passenger comprises two independently moveable foot supports. This additional freedom of movement will make the amusement ride device to resemble reality even closer.

Preferably, the connecting means are designed as a guide structure arranged on the transport part, along which the torso restraint is moveable. The guide structure can e.g. be vertical to allow an up and down movement of the passenger in the torso restraint with respect to the platform. Alternatively, the guide structure is semicircular and perpendicular to the platform to allow a lateral and up and down movement of the passenger. Possibly, a substantial vertical guide structure is curved backwards at the lower part to cause a forward rotation of the trunk of the passenger when squatting during the ride. Preferably, the connecting means comprises a guide part connected to the torso restraint to be guided along the guide structure on the transport part. Alternatively, the connecting means further comprise a hinge to allow for a squatting movement during the ride. In this embodiment, the 'frontal' rotation (from an occupant's point of view) has been set independent of other movements. The occupant can rotate his or her trunk forwards and backwards anytime during the ride in every body position. The connecting means may alternatively comprise a combination of a curved guide structure and a hinge. In order to guide and damp this rotation, preferably damper such as a gas cylinder or spring is implemented in the system. This prevents the occupant from making sudden movements and possibly damaging himself or the system.

Alternatively, the connecting means may comprise springs, (flexible) rods, pistons, etc. etc.

Possibly, the platform supporting the passenger is designed as a surfboard, a skateboard, a snowboard or a pair of skis, e.g. anticipating to a theme of the amusement device. In a preferred embodiment the orientation of the passenger in the torso restraint in the standing position with respect to the transport direction is between 15° and 45°, preferably about 35° (as seen from above) to enhance the experience of surfing on water or snow or skateboarding. This results in an improved overall ride experience, without increasing the speed.

In a specific embodiment, multiple carriages move along a single track. The carriages can move individually along the track or can be coupled to form a train. In this preferred embodiment, each carriage comprises a single transport part with one or two platforms supporting an even number of passengers (one or more pairs of passengers) in a torso restraint in a standing position, which torso restraints are oriented such that the passengers are disposed back to back. E.g., the passengers are disposed in a 2-2 arrangement with their backs towards each other. Hence, two passengers are oriented with their right foot in the direction of transport, while the other two passengers are oriented with their left foot in the direction of transport. Of course, any other formation of the passengers is also possible: one passenger per carriage, or multiple passengers lined up behind each other on a single carriage, which can possibly each be differently orientated with respect to the transport direction.

The passenger torso restraint engaging on the torso of the passenger should be able to safely support the passenger in a standing and in a squatting position, and should be suitable for passengers who have different figures (e.g., tall, short, fat, slender).

In a preferred embodiment, the torso restraint comprises a possibly enclosing back support, an over-shoulder restraint or clamp as described in U.S. Pat. No. 4,531,459 and possibly an additive lap or hip bar. A drawback of such a shoulder restraint might be that the view of the passenger is restricted by the restraint.

Alternatively, the torso restraint may comprise a back support with a hip bar restraint. Possibly, the hip restraint can be hydraulically locked. In a preferred embodiment, an additional belt construction comprising one or two shoulder straps, such as a vest or harness, is provided between the back support and the hip restraint. In a preferred embodiment, the connection of the belt construction with the back support is adjustable, so that the belt construction can be fixed to the back support in multiple positions with varying height. This makes the restraint system more appropriate for passengers with varying lengths.

With only an upper restraint, occupants can slide out of the restraint fairly easy. A lower torso restraint can e.g. be designed as a parachute style groin belt or step-in restraint braces. A disadvantage of such a system might be that they are expensive and time consuming to apply. Preferably, the torso restraint further comprises a saddle between the passengers' legs to provide the adequate support and thus, together with other torso restraint elements provide a total enclosure of the torso of the occupant. The body is supported on the pubic bone and can be compared with sitting on a bicycle saddle. Possibly, a connecting belt and locking mechanism is present between the belt construction, shoulder restraint, lap bar or hip bar and this saddle, possibly as a redundant fastening system. The shape of the saddle is very important for its function as well as for legislation and for comfort of the occupants. The saddle has to support the pubic bone and should not leave too much room for people to get out of the restraint during the ride. Also, the width of the saddle should be tested empirical since small children (1.40 m) should fit the saddle as well as relatively fat persons with less or nearly no space between the legs.

Possibly, an additional bracket is provided behind the upper end of the legs of the occupant to prevent occupants from hyperextending their knees. This knee-bracket can be provided with a height-depending system or can be situated such that a small person will have the bracket nearly in the back of his knee and a large person will feel this bracket high up the back side of his upper leg.

In addition, the transport part of the carriage can further comprise one or more pairs of foot restraints on the platform, or alternatively a single foot restraint per passenger. The torso restraints will probably prevent the occupant from evacuation during the ride, allowing the foot restraints to prevent uncontrollable vertical movements and extreme excursions of the legs. A certain angle between the feet is advisable in order to provide a safe and comfortable squatting movement during the ride. An amount of 20° between the sagittal planes of the feet appeared to be a suitable angle. In relation to the sagittal plane of the body, the toes should point outwards. In the snowboard industry, this is called the 'duckstance'. A preferred embodiment of the foot restraint comprises a rotating front part that travels towards a fixed rear part, by which the ankle of the occupant is restrained. The system can be closed and locked by a hydraulic piston.

Possibly, the foot restraint restrains the foot and ankle of the passenger, but the connection between the foot restraint and the platform enables some degree of tilting of the foot or feet when simulating a skiing movement.

Because of safety reasons, a manual check of the restraints prior the ride can be requested. To check an upper main body restraint the operator can e.g. pull a lap bar or pull on a vest to check whether the system is locked or not. A belt between the lap bar and saddle can also be checked visually or with a quick grip. Possibly present foot restraints though, demand the operator to bend over and pull each foot restraints. This will become considerably uncomfortable for the operator and will take a fair amount of dispatch time. A possible system by which the operator can quickly check the status of the foot restraints without too much effort and time is created by adding two pedals per occupant on the edge of the base floor plate, which are connected to the foot restraints. With this system, the operator can visually check the status of the foot restraints. Also, by stepping on the pedals (while—for instance—checking the body restraint), the foot restraints are pushed open by which the operator can check whether the system is locked properly or not. An unequal pedal position might indicate an unequal closure of the feet (are both feet in the right place) or a failure in the system. The operator can, when park policy allows it, easily press the foot restraints tighter on the restraints themselves if needed. This is a relatively low cost, mechanical solution that can easily be implemented in a coach.

Preferably the up and down movement of torso restraint with respect to the platform is limited to a lowermost position to support occupants when a high downwardly directed vertical load is experienced, or when people cannot or do not want to stand anymore, e.g. in case of fainting. Also an uppermost position is preferably provided to prevent too large forces on the legs of the passenger when experiencing high upwardly directed vertical loads. Advantageously, the upper- and/or lowermost position of the torso restraint with respect to the platform is adjustable depending on the length and possibly also the weight of the passenger.

In a preferred embodiment, a damper system damps the movements of the passenger to prevent excessive loads and impact on the human body. Possibly, a spring or alternatively an hydraulic or gas damper is used to dampen the movements of the torso restraint.

Even more preferably, an adjustable damper system is provided based on the weight of the passenger. The weighing of the passenger can occur directly, e.g. by a standing on a balance before entering the ride, or by a weighing system below the feet of the passenger. Once the occupant stands in foot restraints, the mass of the occupant is weighed and the smothering setting of the damper can be adjusted.

It is advantageously to provide for a passenger weight compensation system, e.g. by an upward force on the torso of the passenger, e.g. via the restraint, e.g. the saddle. The upward force on the torso experienced during the ride can be adjusted to the weight and/or height of the passenger. Possibly, weighing of the person can be performed indirectly by pressure measuring means measuring the upward force exerted on the passenger.

In a preferred embodiment of the invention, the torso restraint moves—with its mass—along with the body of the occupant. The influence of this added weight (and thus moment of inertia) can preferably be compensated by the implementation of a weight compensating system. For example, in a fully weight compensated system, the total weight of the torso restraint is compensated by a counterweight with an additional 2 to 4 kilograms, which will be experienced as a light pressure on the pubic bone.

In an alternative embodiment according to the invention, the amusement ride device comprises a track and at least one carriage, which carriage is moveable along the track in a transport direction, which carriage comprises:

- a transport part which engages on the track comprising at least one passenger torso restraint engaging on the torso of the passenger for safely supporting the passenger, which transport part allows to support at least one passenger,
- a platform,
- connecting means which connect the platform to the transport part, which connecting means are designed to allow the passenger to perform movements during the ride while being restrained by the torso restraint, wherein the torso restraint performs a movement with respect to the platform during said movements of the passenger.

Figure 4:
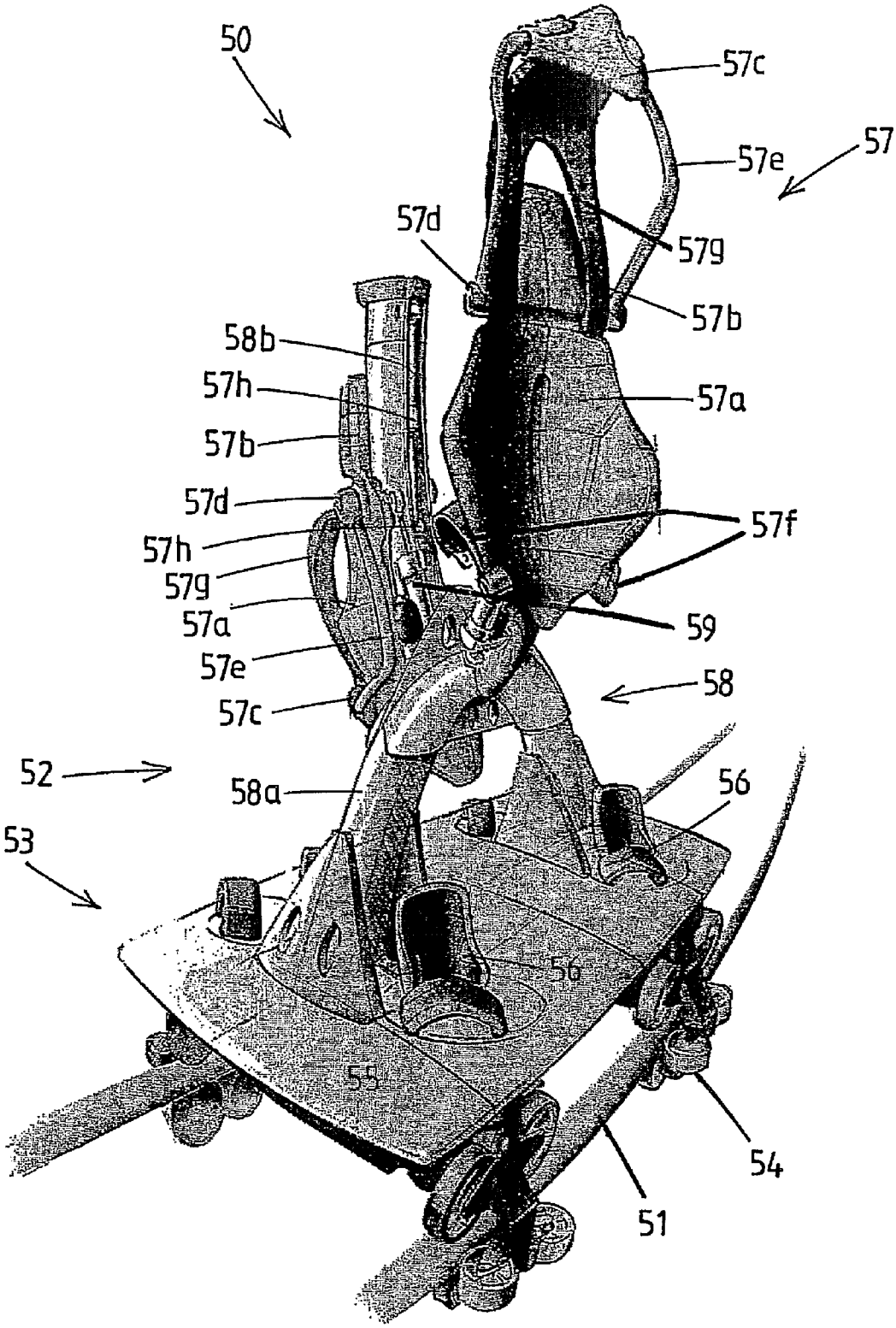
Figure 5:
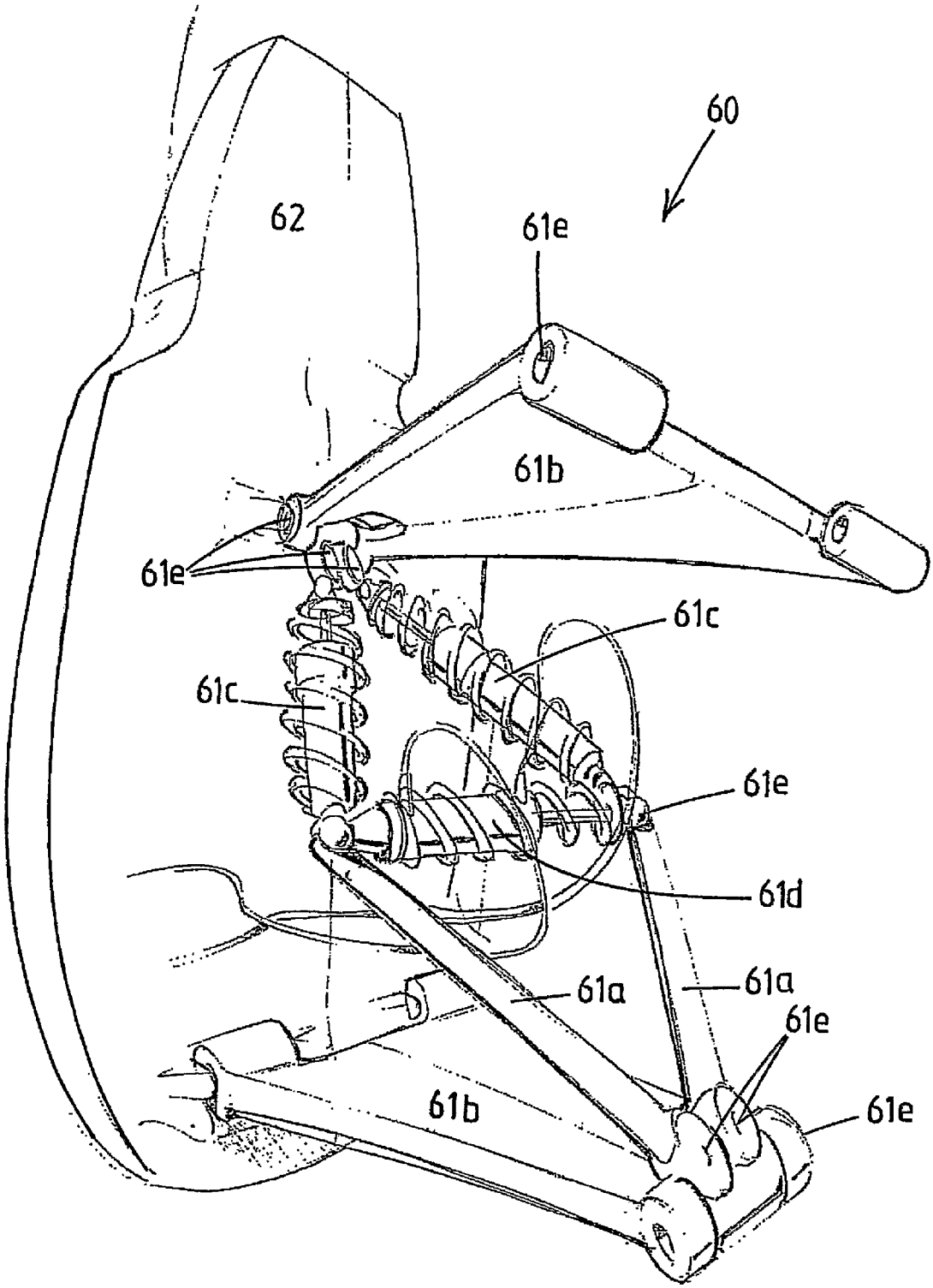
Figure 6:
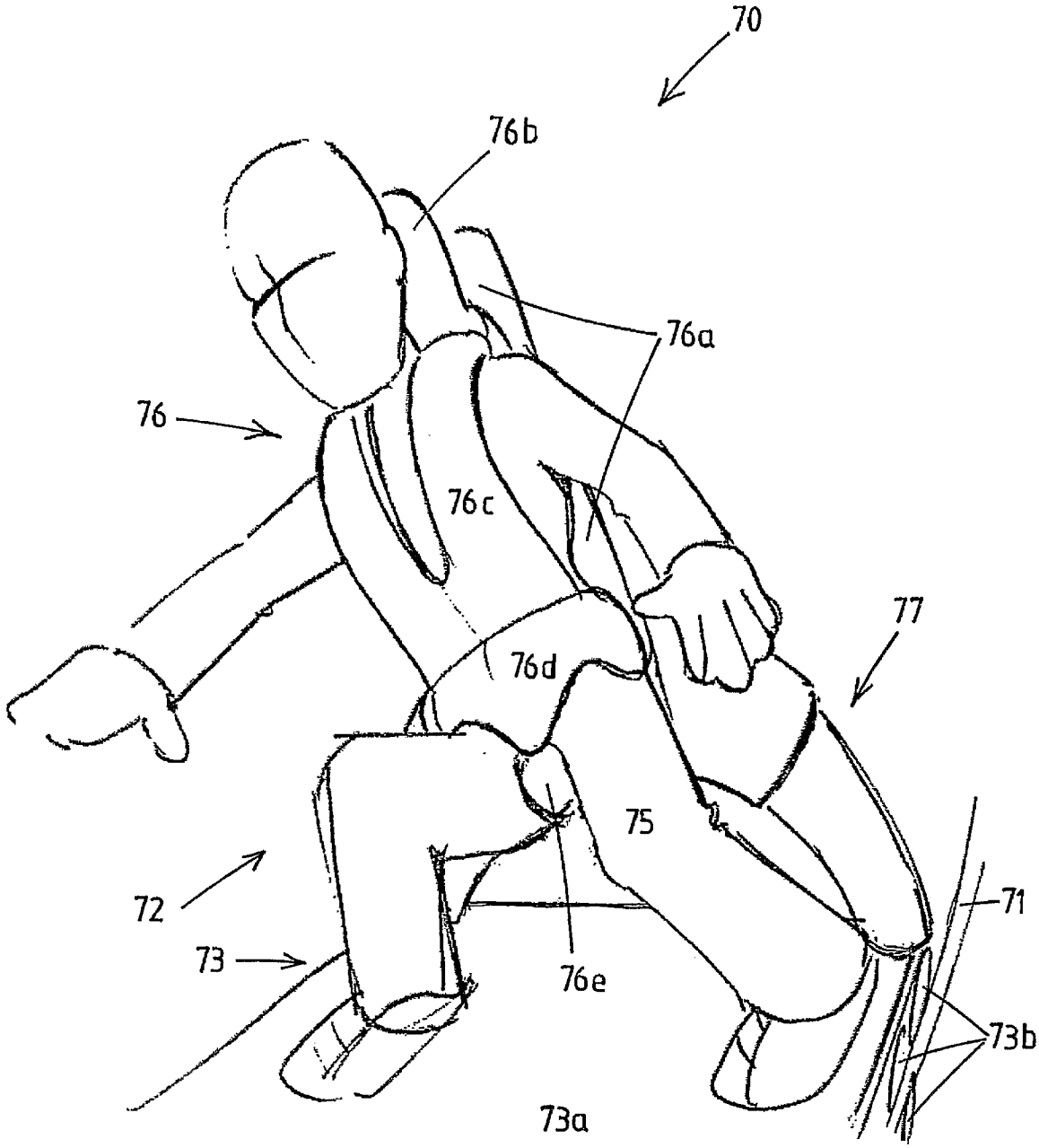
Figure 7:
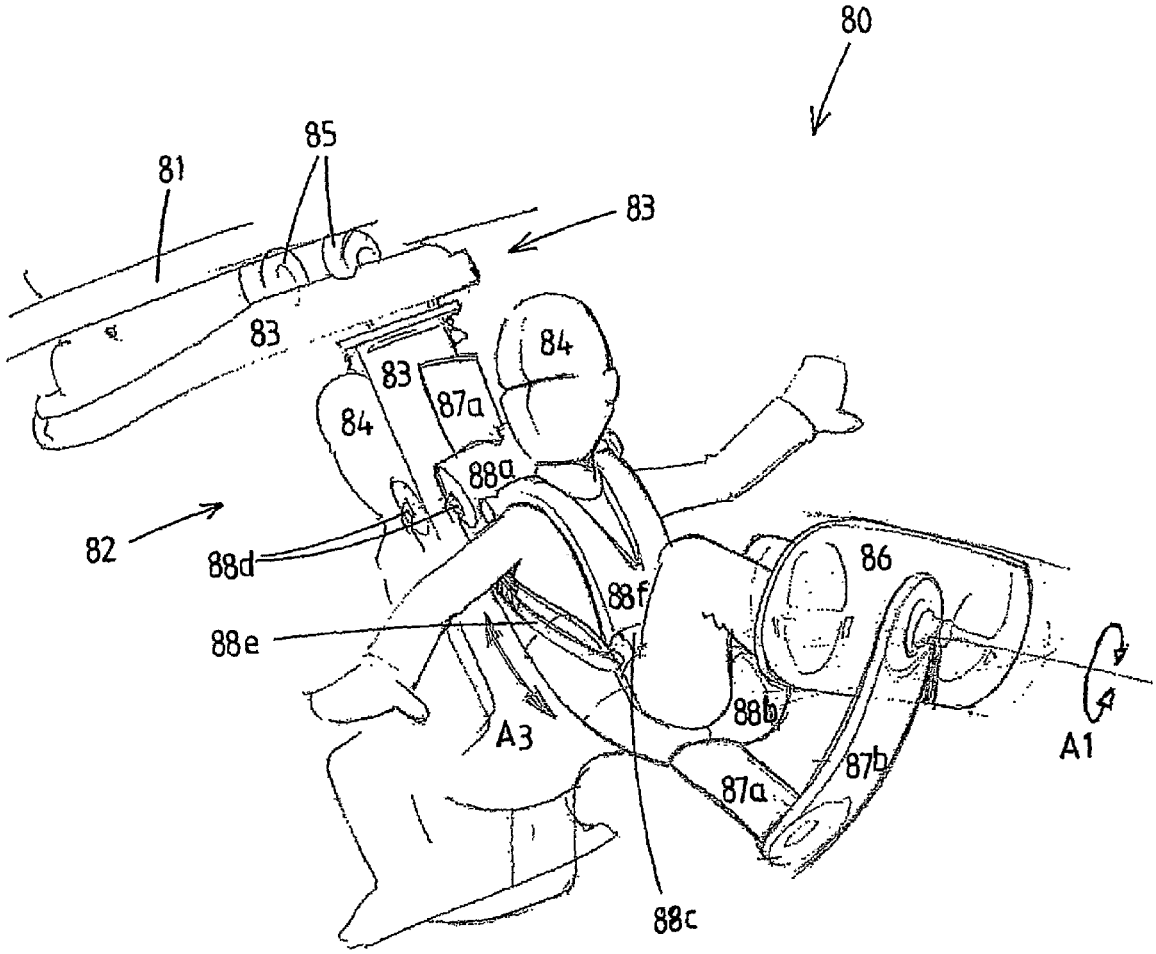
Figure 8:
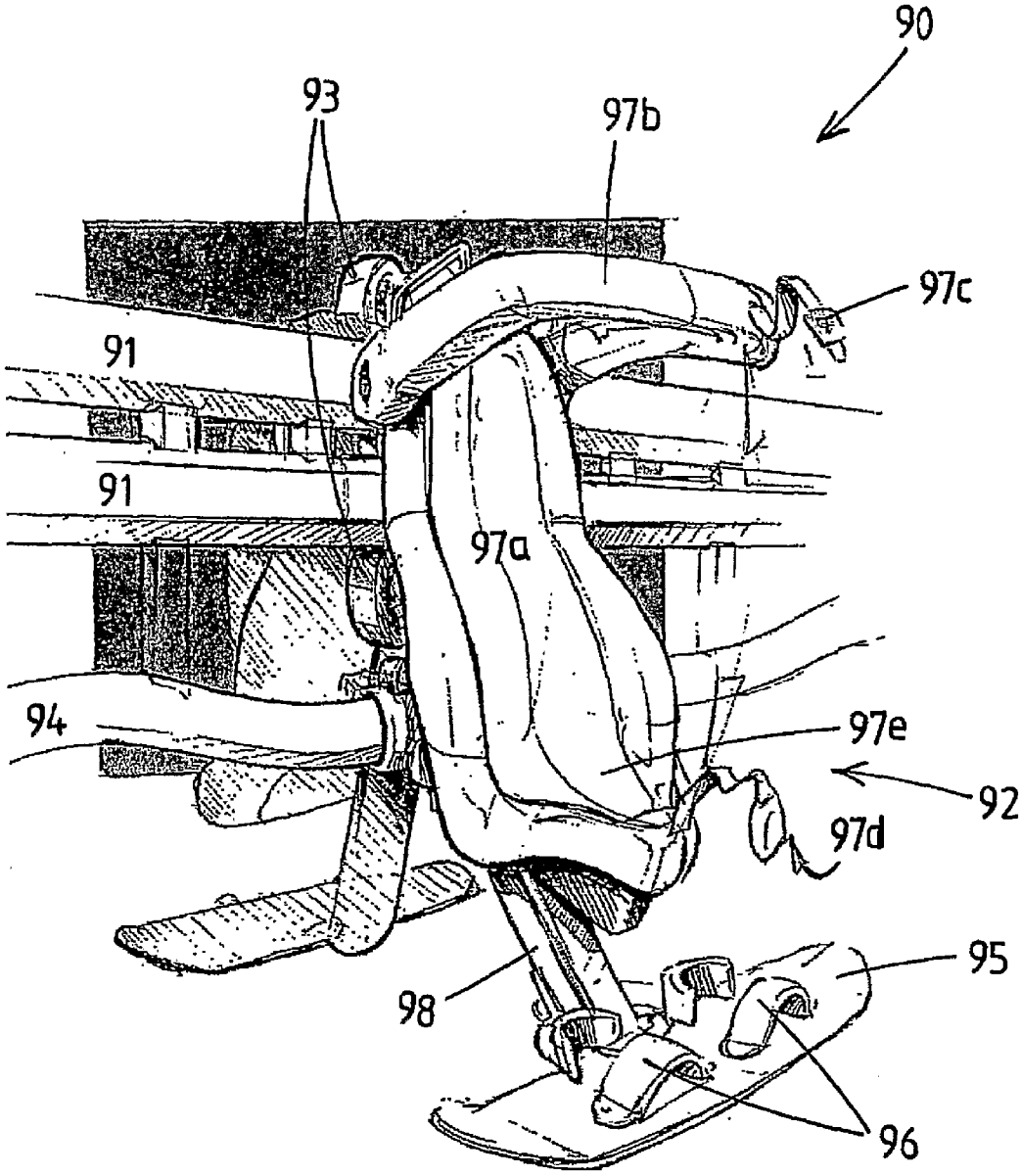

The invention will be explained in detail with respect to the drawings, in which:

FIGS. 1*a*-1*c* depict a schematic side view of a preferred embodiment of a carriage according to the invention, FIGS. 2*a*-2*d* depict a schematic perspective view of a second preferred embodiment of an amusement ride device according to the invention, FIGS. 3*a*-3*c* depict a schematic perspective view of a third alternative embodiment of an amusement ride device according to the invention, FIG. 4 depicts a schematic perspective view of a fourth alternative embodiment of an amusement ride device according to the invention, FIG. 5 depicts a schematic perspective view of a fifth alternative embodiment of an amusement ride device according to the invention, FIG. 6 depicts a schematic perspective view of a sixth alternative embodiment of an amusement ride device according to the invention, FIG. 7 depicts a schematic perspective view of a seventh alternative embodiment of an amusement ride device according to the invention, FIG. 8 depicts a schematic perspective view of an eight alternative embodiment of an amusement ride device according to the invention.

In FIG. 1 a schematic side view of a carriage 1 is presented. Carriage 1 comprises a schematically depicted transport part 2, which transport part can engage on a track of an amusement ride device (not shown). Transport part 2 comprises a platform 3 that allows to support a passenger (not shown) in a standing position thereon. The carriage further comprises connecting means which connect the transport part 2 to a torso restraint 5. In this embodiment, the connecting means comprise a guide structure 4 along which the torso restraint 5 is moveable in a substantial vertical direction, as visible from FIG. 1*b*. In this embodiment, the platform 3 is provided above the track. It is known from prior art that the torso restraint 5 is moveable along the guide structure 4 to adjust the torso restraint 5 to the height of the passenger. In prior art, the torso restraint 5 is adapted to the passenger after boarding and subsequently fixed before the start of the ride. According to the invention, the guide structure 4 is designed to allow the passenger to perform movements during the ride between the standing position and a squatting position while being restrained by the torso restraint 5. The torso restraint 5 performs an up and down movement with respect to the platform 3 during said squatting movements of the passenger. In FIG. 1*c* it is schematically depicted that the connecting means between the passenger torso restraint 5 and the platform 3 also allow for a rotation of the torso of the passenger and the torso restraint 5 when the passenger squats during the ride. Details on the operation will be given below.

The embodiment of the torso restraint 5 shown in FIG. 1 comprises a back support 6, a hip bar 7, saddle 8 and bracket 9. Back support 6 comprises a head rest 6*a* and a lumbar support 6*b*. This will fix the passenger more firmly into the seat and will increase the sense of safety of the passenger. Hip bar 7 is rotatable about pivot axis 7*a* by pivot arms 7*b*. Hip bar 7 will be pivoted upwards when entering the amusement ride device, and when the passenger has entered he can lower the hip bar 7 himself or this will occur automatically, e.g. with the aid of hydraulics. The passenger sits/stands on the saddle 8 resembling sitting on a bicycle saddle. Optional bracket 9 prevents hyperextending of the knees ('locking' of the knees) when entering the carriage and during the ride. The connecting means which connect the transport part 2 to a torso restraint 5 comprise the guide structure 4 and a guide part (not shown) to be guided along the guide structure 4 on the transport part 2. This guide part (not shown) is connected to a frame part 10 onto which all elements of the torso restraint 5 are mounted. The connecting means further comprise a hinge (not shown) between this guide part (not shown) and frame part 10 allowing a forward rotational movement of the torso restraint 5 about this hinge, enabling a forward rotation of the trunk or torso of the passenger during the ride while being restrained by the torso restraint 5. This rotation is shown in FIG. 1*c*.

Figure 2A:
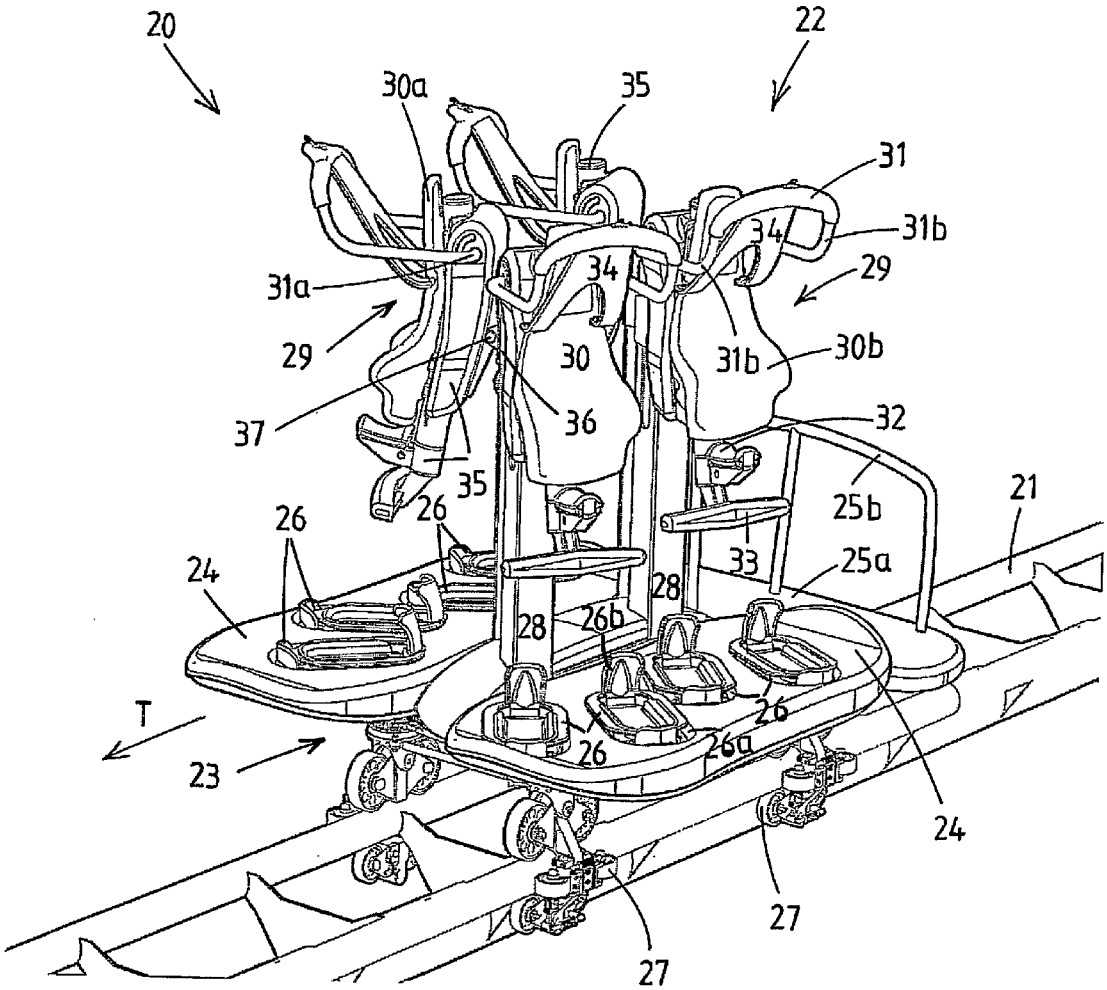

In FIG. 2*a* an amusement ride device 20 is shown, comprising a track 21 and a carriage 22. In this embodiment, four passengers (not shown) are disposed on a single carriage 22 in a 2-2 arrangement with their backs towards each other. Two passengers are oriented with their right foot in the direction of transport T, while the other two passengers are oriented with their left foot in the direction of transport T. Of course, any other formation of the passengers is also possible.

Carriage 22 comprises a transport part 23 sliding across track 21 with four sets of guide wheels 27. Transport part 23 comprises two platforms 24 supporting the passengers (not shown) in a standing position. Platform 24 is in this embodiment designed as a surfboard, skateboard or snowboard, and can be tuned to the scenery and/or theme of the amusement ride device 20. A boarding platform 25*a* and handrail 25*b* is connected with the platform 24.

Each platform 24 is provided with 2 sets of foot restraints 26. A small angle between the feet is present in order to provide a safe and comfortable squatting movement during the ride. The toes point outwards, which is in the snowboard industry called the 'duckstance'. The shown embodiment of the foot restraint 26 comprises a rotating front part 26*a* that travels towards a fixed rear part 26*b*, by which the ankle of the occupant is restrained. The system can be closed and locked by a hydraulic piston (not shown).

The carriage 22 further comprises connecting means which connect the transport part 23 to four torso restraints 29. The connecting means in this embodiment comprise four guide structures 28 along which the torso restraints 29 are moveable up and down with respect to the transport part 23, in this embodiment in a substantial vertical direction.

The embodiment of the torso restraint 29 shown in FIG. 2 comprises a back support 30, a hip bar 31, saddle 32 and bracket 33. Back support 30 comprises a head rest 30*a* and a lumbar support 30*b*. This will fix the passenger more firmly into the seat and will increase the sense of safety of the passenger. Hip bar 31 is rotatable about pivot axis 31*a* by pivot arms 31*b*. Hip bar 31 will be pivoted upwards when entering the amusement ride device, and when the passenger has entered he can lower the hip bar 31 himself or this will occur automatically, e.g. with the aid of hydraulics. A vest (or harness) 34 is provided between the hip bar 31 and the back rest 30 to furthermore restrain the passenger. Possibly this vest can be adapted to the height of the passenger. Preferably, the vest comprises an adjustable belt system to adapt the vest also to the size of the passenger. Preferable, the vest is designed as described in copending application PCT/EP2006/004562, hereby incorporated by reference. The passenger sits on the saddle 32 resembling sitting on a bicycle saddle, while being supported by the platform 24 in a standing position. Bracket 33 prevents hyperextending of the knees ('locking' of the knees) when entering the carriage and during the ride.

The connecting means comprising guide structures 28 further comprise guide parts 36 to be guided along the guide structure 28 on the transport part 23. These guide parts 36 are connected to frame parts 35, onto which elements of the torso restraint 29 are mounted. The connecting means further comprise hinges 37 between guide part 36 and frame part 35, to allow for a forward rotational movement of the torso restraint 29 about this hinge 37, allowing a forward rotation of the trunk of the passenger.

A damper or gas spring is preferably provided in guide structure 28 to dampen the up and down movement of the passenger. The position of the hinge 37 is behind the back of the person, preferably behind the lower part of the back to allow for a natural forward rotational movement while squatting.

Figure 2B:
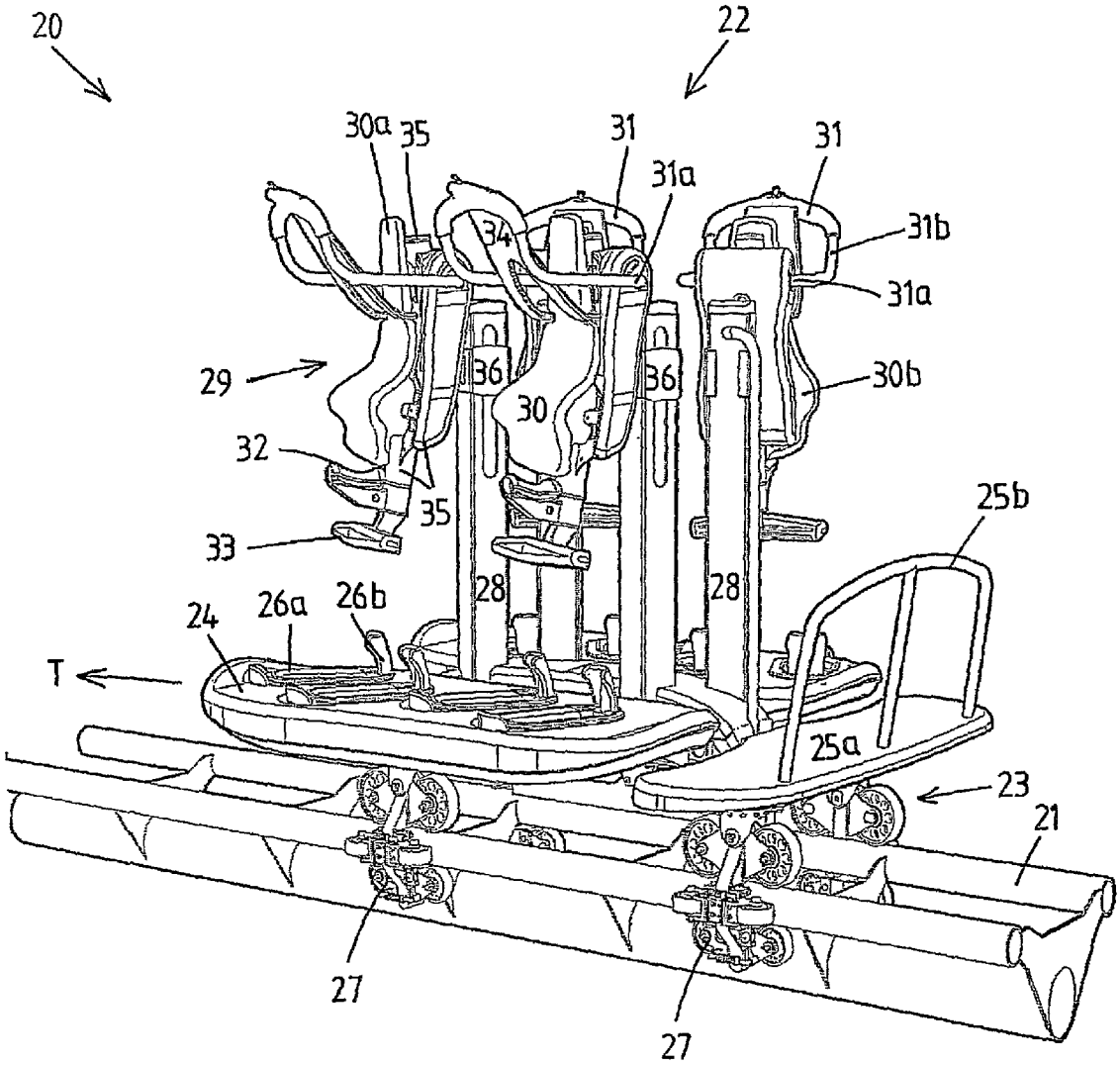

FIG. 2*b* shows the same embodiment as shown in FIG. 2*a*, but from another perspective. Same components are given same numerals, but are possibly better or worse visible.

Figure 2C:
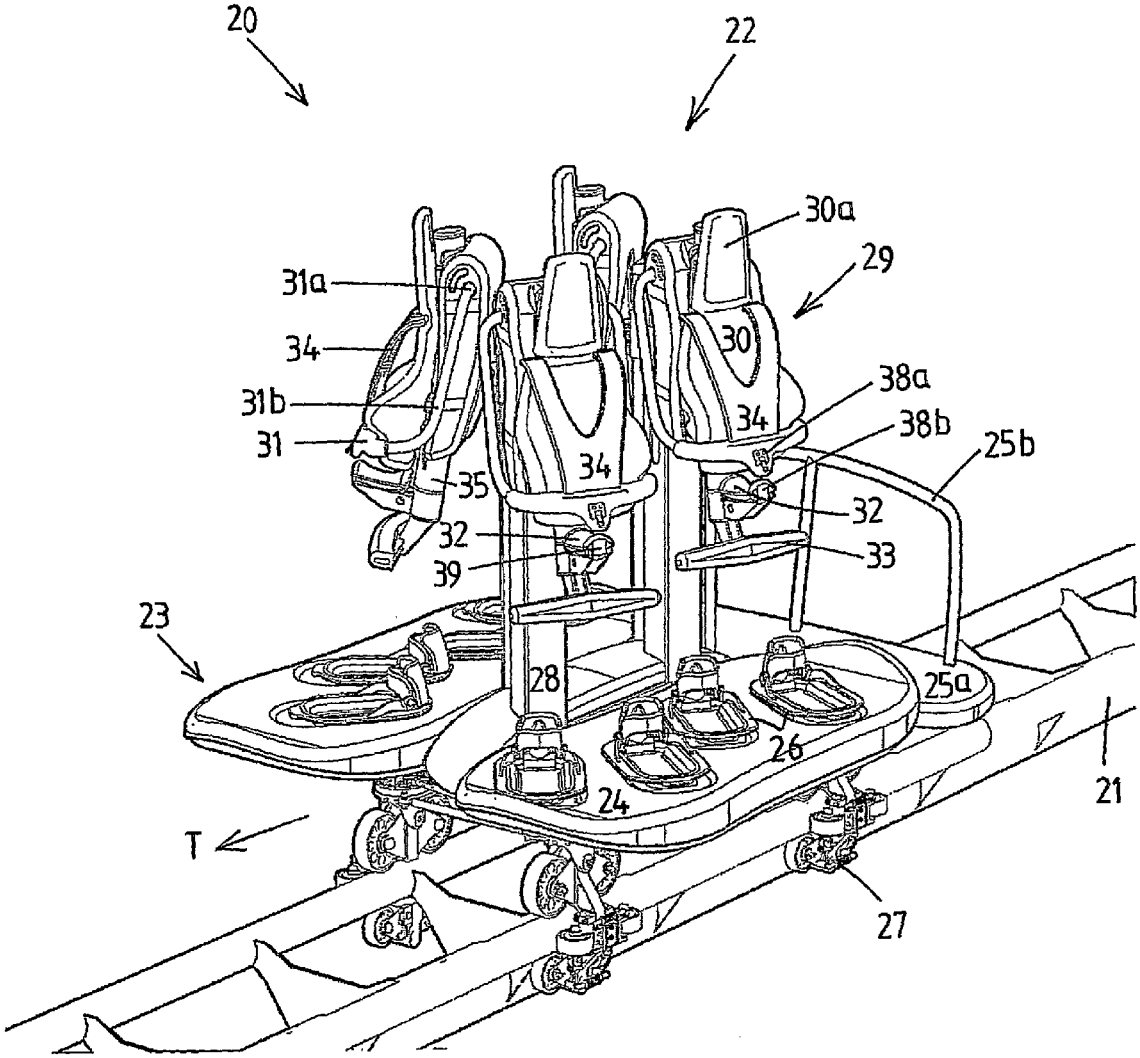

The perspective of FIG. 2*c* is the same as that of FIG. 2*a*, but the torso restraint 29 is now closed (without passengers being present). In the shown embodiment a locking member 38*a* is visible on hip bar 31, that can lock vest 34, or alternatively a belt or belt system (not shown) to a lock 38*b* provided in saddle 32.

Figure 2D:
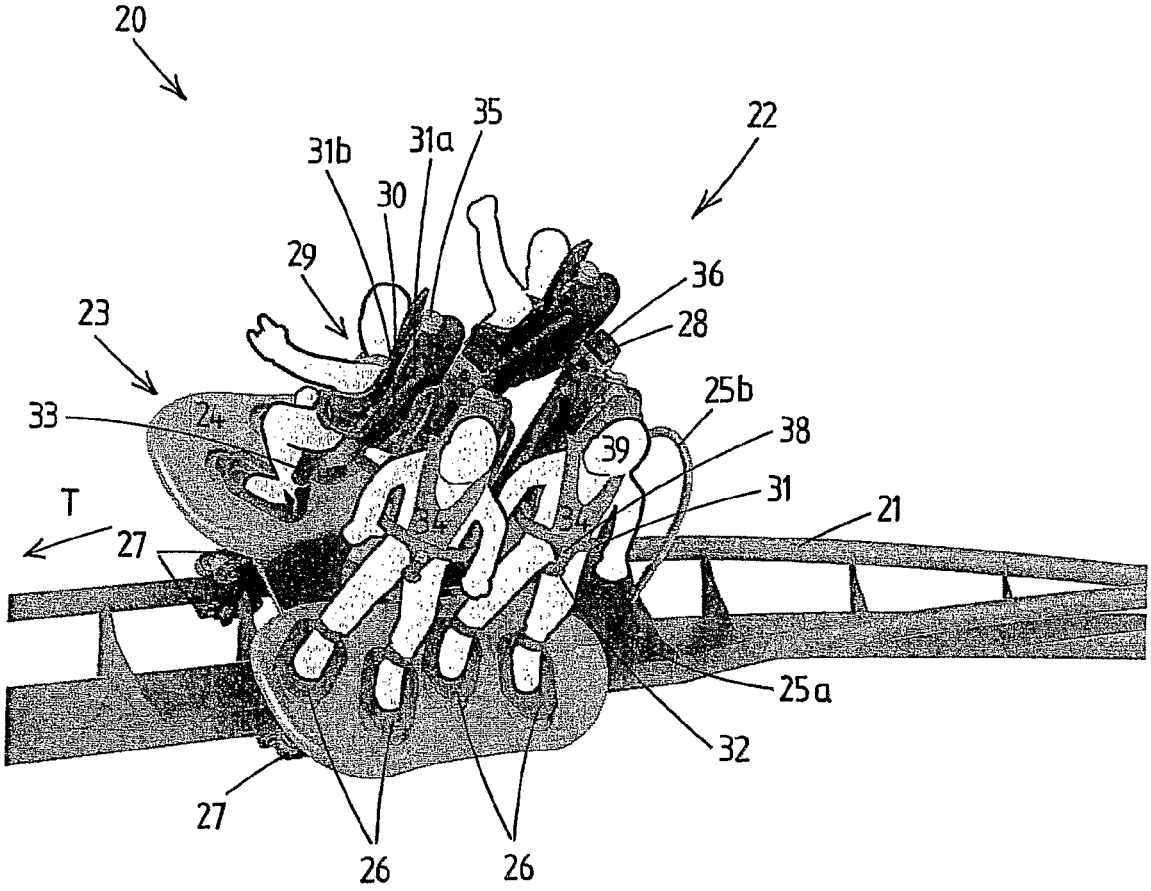

FIG. 2*d* shows the embodiment shown in FIGS. 2*a*-2*c* with passengers 39.

In FIGS. 3*a*-3*c* an alternative embodiment of an amusement ride device 40 is depicted. In the previous shown embodiments, the passenger embarks and disembarks the amusement ride device in a standing position, and can squat during the ride. It can be seen that alternatively, e.g. in this embodiment, the passenger embarks the amusement ride device in a sitting position, and can stand up and squat during the ride. Possibly, aids are provided to help the passenger to stand up from the squatted position. For example, rods or rails are provided.

The device 40 comprises a track 41 and a carriage 42. The carriage 42 comprises a transport part 43 comprising a platform 44, that allows to support a passenger 45 in a sitting position (FIG. 3*a*), a squatting position (FIG. 3*b*) and in a standing position (FIG. 3*c*) thereon. The transport part 43 engages on the track 41 with guide wheels 43*a* and is free to move along the track 41 in a transport direction T. The carriage 42 further comprises a torso restraint 46 for safely supporting passenger 45 in a sitting, squatting and a standing position. In the shown embodiment, the torso restraint 46 comprises a shoulder restraint 47 and a back rest 48 comprising a head rest 48*a* and a lumbar support 48*b*, and possibly some kind of seat or saddle (not shown), e.g. a semi-seat, possibly nothing more than a ladies' bicycle saddle or small ridge, to sit on in the position shown in FIG. 3*a*. Shoulder restraint 47 is pivotable about pivot axis 47*a*.

Connecting means 49 connect torso restraint 46 to transport part 43, which connecting means 49 allow an up and down movement of the torso restraint 46 with respect to the platform 44. Connecting means 49 further allow the passenger 45 to perform movements during the ride between the standing position and a squatting position and a forward rotational movement of the torso of the passenger while squatting and standing, while continuously being restrained by the torso restraint 46. The torso restraint 46 performs an up and down movement with respect to the platform 44 during said movements of the passenger 45. The connecting means 49 in this embodiment comprise pistons 49*a*, possibly dampers or gas springs, and rods 49*b*. The connecting means allow a lowermost position of the torso restraint and the passenger to rest or sit when fainted. Possibly, the connecting means 49 also aid to help the passenger to stand up from the squatted position when the ride takes off.

In FIG. 4 a fourth embodiment of an amusement ride device 50 according to the invention is shown. The amusement ride device 50 comprises a track 51 and a carriage 52. The carriage comprises a transport part 53 which engages on the track 51 by four sets of guide wheels 54. The transport part 53 comprises a platform 55 that allows to support two passengers (not shown) in a standing position thereon. The passengers will be disposed back-to-back on platform 55, with their feet in the two sets of foot restraints 56 provided on the platform 55. The passengers will further be restrained by a torso restraint 57. The torso restraint 57 in this embodiment comprises a back rest 57*a*, a head rest 57*b*, a hip bar 57*c* which is pivotable about pivot axis 57*d* by pivot arms 57*e* and a parachute style hip restraint 57*f* which is a flexible belt to be placed along the groins of the passenger and connected to the hip bar 57*c*, thereby forming an X-shaped restraint. Between hip bar 57*c* and back restraint 57*a* a vest 57*g* is provided. The restraint 57 visible in a (large) front view is in an open position, allowing the entry of a passenger, while the (smaller) restraint 57 visible partly from behind is in a closed position.

The torso restraint 57 is connected to the transport part 53 by connecting means 58. Connecting means 58 comprise a U-shaped frame part 58*a*, to which two tubular-shaped hollow guide structures 58*b* are connected (only one of which is visible in FIG. 4). The connecting means comprise various guide parts 57*h* connected to torso restraint 57 that can be guided along the guide structure 58*b* to allow an up and down movement of the torso restraint 57 with respect to the platform 55, and to allow the passenger to perform movements during the ride between a standing position and a squatting position while being restrained by the torso restraint 57. To dampen the movements of the passenger a cylinder, possibly a hydraulic cylinder 59 is provided to dampen the motion of the passenger. To also cause a forward rotational movement of the torso of the passenger during the ride while being restrained by the torso restraint 57 the guide structure 58 is curved backwards.

In FIG. 5 a fifth embodiment of a detail of a carriage 60 is shown. A schematic view of a back rest 62 of a passenger torso restraint is visible, and part of connecting means 61 to connect the passenger torso restraint 62 to a transport part (not shown). The connecting means might further comprise a column (not shown) at the right-hand side of the drawing that can be placed on a platform (not shown). The shown part of connecting means 61 are designed as a so-called double wishbone construction, in the shown embodiment comprising rods 61*a*, plates 61*b*, diagonal dampers 61*c* and a horizontal damper 61*d*, all pivotable about pivot axes 61*e*. The horizontal damper 61*d* can be used to adjust the connecting means 61 to the height of the passenger. The two diagonal dampers 61*c* allow for a vertical movement of the passenger. The double wishbone geometry realizes a forward rotation of the back rest 62 of about 15-20°. A disadvantage of this system is the small variety in lengths of persons that can seat in this carriage.

In FIG. 6 a schematic perspective view of a sixth embodiment of an amusement ride device 70 according to the invention is shown. In this embodiment, the passenger is allowed to perform a skiing movement, comprising an up and down movement and a lateral sideways movement. The amusement ride device 70 comprises a track 71 and a carriage 72. Carriage 72 comprises a transport part 73. Transport part 73 comprises wheels 73*b* that engage on the track 71 and a platform 73*a* that allows to support a front facing passenger 75 in a standing position thereon.

Carriage 72 further comprises a passenger torso restraint 76 engaging on the torso of the passenger 75 for safely supporting the passenger in at least the standing position. The shown passenger torso restraint 76 comprises a back support 76*a* with a head rest 76*b*, a shoulder restraint 76*c* and hip restraint 76*d* in one piece and a saddle 76*e*. The hip restraint 76*d* is connected to the saddle 76*e* via a locking mechanism (not shown).

Carriage 72 further comprises connecting means 77 which connect the passenger torso restraint 76 to the transport part 73. Connecting means 77 are designed to allow a lateral movement of the torso of the passenger 75 during the ride while being restrained by the torso restraint 76, wherein the torso restraint 76 performs a movement with respect to the platform 73*a*. Simultaneously, the passenger 75 performs movements between the standing position and a squatting position, wherein the torso restraint 76 performs an up and down movement with respect to the platform 73*a* during said movements of the passenger 75. Connecting means 77 comprise a semicircular guide structure (only part of which is visible).

In FIG. 7 a schematic perspective view of an eighth embodiment of an amusement ride device 80 according to the invention is shown. The amusement ride device 80 comprises a track 81 and a carriage 82. In this embodiment, the carriage 82 is suspended under the track 81.

Carriage 82 comprises a transport part 83 comprising wheels 85 that engage on the track 81. The transport part 83 in this embodiment comprises a platform 86, onto which the feet of passengers 84 are restrained by a pair of foot restraints (not shown). Each shown platform 86 allows to support a passengers 84. The platform 86 is moveable to some extent with respect to the transport part 83 in that the platform can perform a rotational movement indicated by arrow A1.

Carriage 82 further comprises two passenger torso restraints 88 engaging on the torso of the passengers 84 for safely supporting the passengers 84. The torso restraints 88 comprise a back rest 88*a*, a saddle 88*b*, a hip bar 88*c* which is pivotable about pivot axis 88*d* by pivot arms 88*e*. A vest 88*f* is present between the hip bar 88*c* and the back rest 88*a*, extending over the torso and shoulders of passenger 84. The torso restraints 88 are connected to transport part 83 by connecting means 87, which connecting means 87 comprise a connection plate 87*b* and a guide structure 87*a*. The guide structure 87*a* which connect the torso restraint 88 to the transport part 83 is designed to allow the passenger 84 to perform a squatting movement of the legs during the ride while being restrained by the torso restraint 88, wherein the torso restraint 88 performs an up and down movement with respect to the platform 86 during said movements of the passenger 84, indicated by arrow A3.

In FIG. 8 part of an amusement ride device 90 is shown in perspective, comprising a track 91 and one carriage 92, which carriage 92 is moveable along the track 91 in a transport direction. The carriage 92 comprises a transport part 93 comprising wheels and a frame part engaging on the track 91. Substantially parallel to the track 91, a guide track 94 is provided.

Carriage 92 further comprises a platform 95 that allows to support the feet of at least one passenger by a pair of foot restraints 96.

Carriage 92 further comprises two passenger torso restraints 97 engaging on the torso of the passenger for safely supporting the passenger. The torso restraint 97 comprises a back support 97*a*, an over shoulder restraint 97*b*, a buckle security lock 97*c* that can lock into locking member 97*d* arranged on seat 97*e*.

In the shown embodiment, the passenger torso restraint 97 is fixedly connected to the transport part 93 in a suspended manner to support the passenger, while the platform 95 is connected by connecting means 98 to the transport part 93, which connecting means 98 are designed to allow the passenger to perform movements during the ride while being restrained by the torso restraint 97, wherein the torso restraint 97 performs a movement with respect to the platform 95 during said movements of the passenger. In the shown embodiment, the guide track 94 imposes movements of the platform 95 with respect to the restraint 97.

The invention claimed is:

1. An amusement ride device, comprising a track and at least one carriage, wherein the carriage is moveable along the track in a transport direction, wherein the carriage comprises:

a transport part which engages on the track, and at least one platform that allows to support the feet of at least one passenger in a standing position thereon, wherein the transport part comprises at least one passenger torso restraint, the passenger torso restraint engaging on the torso of the passenger for safely supporting the passenger in at least the standing position, the at least one platform being connected by connecting means to the transport part, and wherein the connecting means is designed to allow the passenger to perform movements between the standing position and a squatting position during the ride while being restrained by the torso restraint, wherein the torso restraint performs an up and down movement with respect to the platform during said movements of the passenger.

2. The amusement ride device according to claim 1, wherein the connecting means is designed to allow a forward rotational movement of the torso of the passenger during the ride while being restrained by the torso restraint.

3. The amusement ride device according to claim 1, wherein the connecting means is designed to allow a lateral movement of the torso of the passenger during the ride while being restrained by the torso restraint.

4. The amusement ride device according to claim 1, wherein the connecting means is designed as a guide structure arranged on the transport part, along which the torso restraint is moveable.

5. The amusement ride device according to claim 4, wherein the guide structure is curved to cause a forward rotation of the torso restraint when squatting.

6. The amusement ride device according to claim 4, wherein the connecting means comprises a guide part to be guided along the guide structure, and a hinge to allow for a forward rotational movement of the torso restraint during the ride.

7. The amusement ride device according to claim 1, wherein the torso restraint comprises a back support, a hip bar and a saddle.

8. The amusement ride device according to claim 7, wherein the hip bar is connectable to the saddle via a locking mechanism.

9. The amusement ride device according to claim 7, wherein the torso restraint comprises a belt construction comprising one or two shoulder straps between the hip bar and the back support.

10. The amusement ride device according to claim 9, wherein the connection of the belt construction with the back support is adjustable, so that the belt construction can be fixed to the back support in multiple positions with varying height.

11. The amusement ride device according to claim 7, wherein the torso restraint comprises a bracket below the saddle which will be behind the legs of the passenger to prevent hyperextending of the knees of the passenger.

12. The amusement ride device according to claim 1, wherein the torso restraint comprises a back support, a shoulder restraint and a saddle.

13. The amusement ride device according to claim 12, wherein the shoulder restraint is connectable to the saddle via a locking mechanism.

14. The amusement ride device according to claim 1, wherein the transport part further comprises one or more pairs of foot restraints on the platform.

15. The amusement ride device according to claim 1, wherein the platform supporting the passenger is designed as a surfboard, a skateboard, a snowboard or a pair of skis.

16. The amusement ride device according to claim 1, wherein the orientation of the passenger in the torso restraint with respect to the transport direction is between 15° and 45°, preferably about 35° as seen from above.

17. The amusement ride device according to claim 1, wherein the platform is moveable with respect to the transport part.

18. The amusement ride device according to claim 1, wherein the at least one passenger torso restraint is suspended under the track.

19. The amusement ride device according to claim 1, wherein multiple carriages move along a track, wherein each carriage comprises a single transport part with one or two platforms supporting one or more pairs of passengers in a torso restraint, and the torso restraints are oriented such that the passengers are disposed back to back.

20. An amusement ride device, comprising a track and at least one carriage, wherein the carriage is moveable along the track in a transport direction, wherein the carriage comprises:

a transport part which engages on the track and comprises at least one platform that allows to support at least one passenger in a standing position thereon, at least one passenger torso restraint engaging on the torso of the passenger for safely supporting the passenger in at least the standing position, and connecting means which connects the passenger torso restraint to the transport part, wherein the connecting means allows a movement of the torso restraint with respect to the platform, wherein the connecting means is designed to allow the passenger to perform movements between the standing position and a squatting position during the ride while being restrained by the torso restraint, wherein the torso restraint performs an up and down movement with respect to the platform during said movements of the passenger.

21. The amusement ride device according to claim 20, wherein the connecting means is designed to allow a forward rotational movement of the torso of the passenger during the ride while being restrained by the torso restraint.

22. The amusement ride device according to claim 20, wherein the connecting means is designed to allow a lateral movement of the torso of the passenger during the ride while being restrained by the torso restraint.

23. The amusement ride device according to claim 20, wherein the connecting means is designed as a guide structure arranged on the transport part, along which the torso restraint is moveable.

24. The amusement ride device according to claim 23, wherein the guide structure is curved to cause a forward rotation of the torso restraint when squatting.

25. The amusement ride device according to claim 23, wherein the connecting means comprises a guide part to be guided along the guide structure, and a hinge to allow for a forward rotational movement of the torso restraint during the ride.

26. The amusement ride device according to claim 20, wherein the torso restraint comprises a back support, a hip bar and a saddle.

27. The amusement ride device according to claim 26, wherein the hip bar is connectable to the saddle via a locking mechanism.

28. The amusement ride device according to claim 26, wherein the torso restraint comprises a belt construction comprising one or two shoulder straps between the hip bar and the back support.

29. The amusement ride device according to claim 28, wherein the connection of the belt construction with the back support is adjustable, so that the belt construction can be fixed to the back support in multiple positions with varying height.

30. The amusement ride device according to claim 26, wherein the torso restraint comprises a bracket below the saddle which will be behind the legs of the passenger to prevent hyperextending of the knees of the passenger.

31. The amusement ride device according to claim 20, wherein the torso restraint comprises a back support, a shoulder restraint and a saddle.

32. The amusement ride device according to claim 31, wherein the shoulder restraint is connectable to the saddle via a locking mechanism.

33. The amusement ride device according to claim 20, wherein the platform supporting the passenger is designed as a surfboard, a skateboard, a snowboard or a pair of skis.

34. The amusement ride device according to claim 20, wherein the orientation of the passenger in the torso restraint with respect to the transport direction is between 15° and 45°, preferably about 35° as seen from above.

35. The amusement ride device according to claim 20, wherein the at least one passenger torso restraint is suspended under the track.

36. The amusement ride device according to claim 20, wherein multiple carriages move along a track, wherein each carriage comprises a single transport part with one or two platforms supporting one or more pairs of passengers in a torso restraint, and the torso restraints are oriented such that the passengers are disposed back to back.

* * * * *